US010661296B2

(12) United States Patent
Urquhart et al.

(10) Patent No.: US 10,661,296 B2
(45) **Date of Patent: *May 26, 2020**

(54) ADHESIVE DISPENSING ASSEMBLY HAVING A MECHANISM FOR CLEANING THE DISPENSING NOZZLE

(71) Applicant: Precision Valve & Automation, Inc., Cohoes, NY (US)

(72) Inventors: Jonathan Neal Urquhart, Saratoga Springs, NY (US); Andrew John Nally, Greenfield, NY (US); Max Egdorf, Greenville, NY (US)

(73) Assignee: PRECISION VALUE & AUTOMATION, INC, Cohoes, NY (US)

( * ) Notice: Subject to any disclaimer, the term of this patent is extended or adjusted under 35 U.S.C. 154(b) by 0 days.

This patent is subject to a terminal disclaimer.

(21) Appl. No.: 16/409,244

(22) Filed: May 10, 2019

(65) Prior Publication Data

US 2019/0262852 A1 Aug. 29, 2019

Related U.S. Application Data

(60) Continuation of application No. 15/238,275, filed on Aug. 16, 2016, now Pat. No. 10,328,448, which is a division of application No. 14/072,217, filed on Nov. 5, 2013, now Pat. No. 9,433,963.

(60) Provisional application No. 61/722,975, filed on Nov. 6, 2012.

(51) Int. Cl.
*B05B 15/55* (2018.01)
*B05C 5/02* (2006.01)

(52) U.S. Cl.
CPC ..... *B05B 15/55* (2018.02); *B05C 5/02* (2013.01)

(58) Field of Classification Search
CPC ... B05B 15/025; B05B 15/0258; B05B 15/55; B05C 5/02
USPC ..... 222/148, 239
See application file for complete search history.

(56) References Cited

U.S. PATENT DOCUMENTS 4,505,430 A 3/1985 Rodgers et al.
5,194,115 A * 3/1993 Ramspeck ..... B05B 7/0861 156/290
5,292,068 A * 3/1994 Raterman ..... B05B 7/0861 156/578
5,368,233 A * 11/1994 Brusko ..... B05B 7/0861 239/290
5,707,009 A 1/1998 Schneider
6,050,499 A 4/2000 Takayama et al.
6,149,076 A * 11/2000 Riney ..... B05B 7/0861 239/135

(Continued)

OTHER PUBLICATIONS

Restriction Requirement for U.S. Appl. No. 14/072,217 dated Nov. 10, 2014.

(Continued)

*Primary Examiner* — Jeremy Carroll
(74) *Attorney, Agent, or Firm* — Schmeiser, Olsen & Watts, LLP

(57) ABSTRACT

A dispensing assembly is provided that dispenses a dispensing fluid onto a substrate from a nozzle located on the dispensing assembly, wherein, when the dispensing assembly stops dispensing a dispensing fluid from the outlet, a gas is directed at a tip of the nozzle to clean off a residue of the dispensing fluid left on the tip of the nozzle.

16 Claims, 17 Drawing Sheets

(56) References Cited

U.S. PATENT DOCUMENTS

| | | | |
|---|---|---|---|
| 9,433,963 | B2 | 9/2016 | Urquhart |
| 2002/0109019 | A1 | 8/2002 | May |
| 2004/0227008 | A1 | 11/2004 | Runeman |
| 2007/0102539 | A1 | 5/2007 | Riney |
| 2007/0102841 | A1 | 5/2007 | Bondeson |
| 2010/0001099 | A1 | 1/2010 | Onda |
| 2010/0065130 | A1 | 3/2010 | Swab et al. |
| 2010/0230511 | A1 | 9/2010 | Umezawa et al. |

OTHER PUBLICATIONS

Non-Final Office Action for U.S. Appl. No. 14/072,217 dated Jan. 16, 2015.
Final Office Action for U.S. Appl. No. 14/072,217 dated May 7, 2015.
Advisory Action for U.S. Appl. No. 14/072,217 dated Aug. 18, 2015.
Non-Final Office Action for U.S. Appl. No. 14/072,217 dated Dec. 30, 2015.
Notice of Allowance for U.S. Appl. No. 14/072,217 dated Jun. 28, 2016.
Non-Final Office Action for U.S. Appl. No. 15/238,275 dated Aug. 10, 2017.
Final Office Action for U.S. Appl. No. 15/238,275 dated Apr. 11, 2018.
Non-Final Office Action for U.S. Appl. No. 15/238,275 dated Aug. 8, 2018.
Final Office Action for U.S. Appl. No. 15/238,275 dated Dec. 5, 2018.
Notice of Allowance for U.S. Appl. No. 15/238,275 dated Feb. 12, 2019.

* cited by examiner

1000

ADHESIVE DISPENSING ASSEMBLY HAVING A MECHANISM FOR CLEANING THE DISPENSING NOZZLE

CROSS-REFERENCE TO RELATED APPLICATIONS

This application is a continuation application of U.S. application Ser. No. 15/238,275, filed Aug. 16, 2016, and entitled "Adhesive Dispensing Assembly Having a Mechanism for Cleaning the Dispensing Nozzle," which is a divisional application of U.S. application Ser. No. 14/072,217, filed Nov. 5, 2013, and entitled, "Adhesive Dispensing Assembly Having a Mechanism for Cleaning the Dispensing Nozzle," which claims the benefit of and priority to U.S. Provisional Application No. 61/722,975, filed Nov. 6, 2012, and entitled "Adhesive Dispensing Assembly Having an On/Off Fluid Flow Control Proximate a Dispensing Nozzle and a Means for Cleaning the Dispensing Nozzle."

FIELD OF TECHNOLOGY

The following relates to a dispensing assembly and more specifically to embodiments of an adhesive dispensing assembly having a mechanism for cleaning the dispensing nozzle without operator intervention.

BACKGROUND

Applying adhesive to precise locations on surfaces often requires an on/off control of the fluid. Currently, to precisely control fluid, one or more component dispensing valves are located before a mixing element and a dispense nozzle, but the dispensing valves cannot start and stop a flow of the fluid precisely enough to create very discrete starts and stops when dispensing small beads of one or more component adhesives onto a surface. Moreover, common dispensing nozzles often need to be cleaned after one or more dispensing cycles. Many times the dispensing nozzles have some adhesive residue on an outlet of the dispensing nozzles which can cause blockage or an imperfect dispense profile. Attempts to remove this blockage include dipping the nozzle into solvents, manual wiping of the nozzle, or even manual replacement of the dispensing nozzle after a dispensing cycle.

Thus, a need exists for an apparatus and method for an adhesive dispensing assembly having precise on/off fluid flow control with the ability to clean the dispensing nozzle without operator intervention.

SUMMARY

A first aspect relates to a dispensing assembly comprising: a body portion, and a blow-off mechanism operably attached to the body portion, the blow-off mechanism including a cap member having one or more openings proximate a dispensing nozzle configured to dispense a dispensing fluid, wherein a fluid is forced through the one or more openings to blow-off a dispensed fluid residue located at a tip of the dispensing nozzle, wherein the fluid is forced through the one or more openings while the dispensing fluid is not continuously exiting an outlet of the dispensing nozzle.

A second aspect relates to a dispensing assembly comprising: a flow control device for controlling a flow of a fluid through a dispensing nozzle, the flow control device disposed within a body portion of the dispensing assembly, and a mechanism for cleaning the dispensing nozzle without operator intervention, wherein the mechanism for cleaning the dispensing nozzle includes a blow-off mechanism operably attached to the body portion, the blow-off mechanism including one or more openings to allow a fluid to pass through to the dispensing nozzle to remove a dispensed fluid residue from the dispensing nozzle.

A third aspect relates to an end effector configured to attach to a Y axis actuator for moving along a Y axis and a X axis actuator for moving along an X axis, the end effector comprising: a feeding mechanism, the feedings mechanism having a first fluid pathway and a second fluid pathway for advancing a first fluid and a second fluid, a mixing element having a first end and a second end, the first end operably connected to the feeding mechanism, wherein the mixing element is configured to receive the first fluid and the second fluid, and a dispensing assembly having a dispensing nozzle, the dispensing assembly receiving the second end of the mixing element, wherein the dispensing assembly includes a blow-off mechanism to clean off a tip of the dispensing nozzle without operator intervention.

A fourth aspect relates to a method comprising: controlling a flow of a dispensing fluid in an adhesive dispensing assembly at a location proximate a dispensing nozzle, and cleaning the dispensing nozzle by blowing off any dispensed fluid residue from the dispensing nozzle with a blow-off mechanism, wherein the blow-off mechanism is operably attached to a body portion of the adhesive dispensing assembly, the blow-off mechanism including one or more openings to allow a fluid to pass through to the dispensing nozzle to remove a dispensed fluid residue from the dispensing nozzle.

The foregoing and other features of construction and operation will be more readily understood and fully appreciated from the following detailed disclosure, taken in conjunction with accompanying drawings.

BRIEF DESCRIPTION OF THE DRAWINGS

Some of the embodiments will be described in detail, with reference to the following figures, wherein like designations denote like members, wherein.

DETAILED DESCRIPTION

A detailed description of the hereinafter described embodiments of the disclosed apparatus and method are presented herein by way of exemplification and not limitation with reference to the Figures. Although certain embodiments are shown and described in detail, it should be understood that various changes and modifications may be made without departing from the scope of the appended claims. The scope of the present disclosure will in no way be limited to the number of constituting components, the materials thereof, the shapes thereof, the relative arrangement thereof, etc., and are disclosed simply as an example of embodiments of the present disclosure.

As a preface to the detailed description, it should be noted that, as used in this specification and the appended claims, the singular forms "a", "an" and "the" include plural referents, unless the context clearly dictates otherwise.

Figure 1:
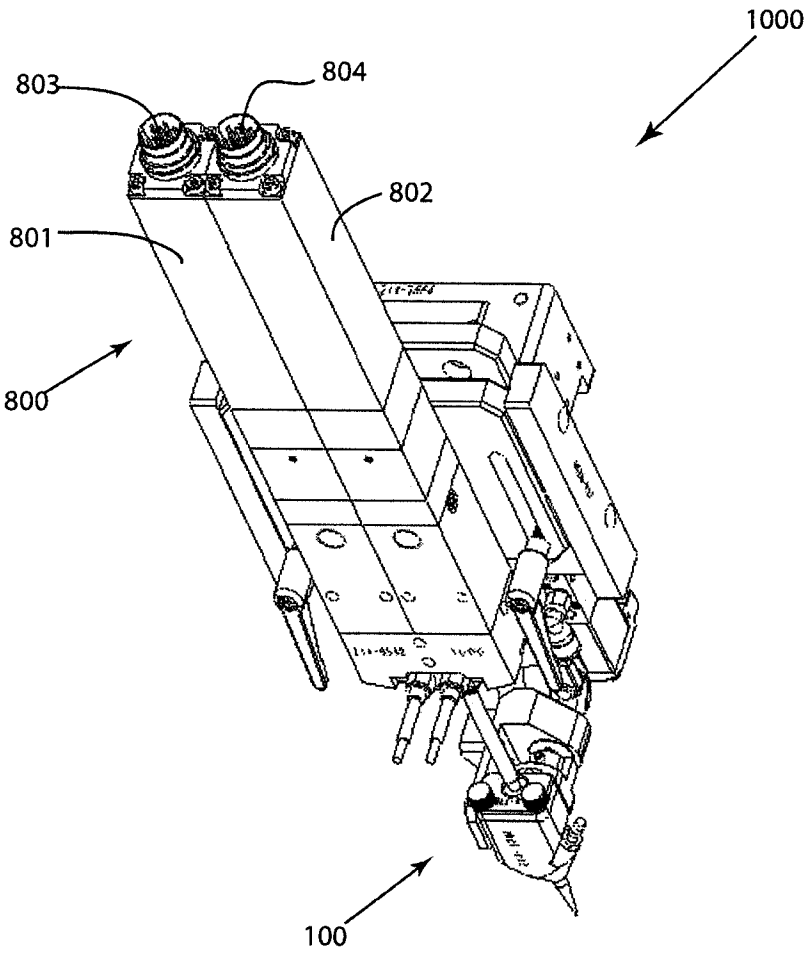
FIG. 1 depicts a front, perspective view of an embodiment of an end effector including a feeding mechanism and a dispensing assembly.
Figure 2:
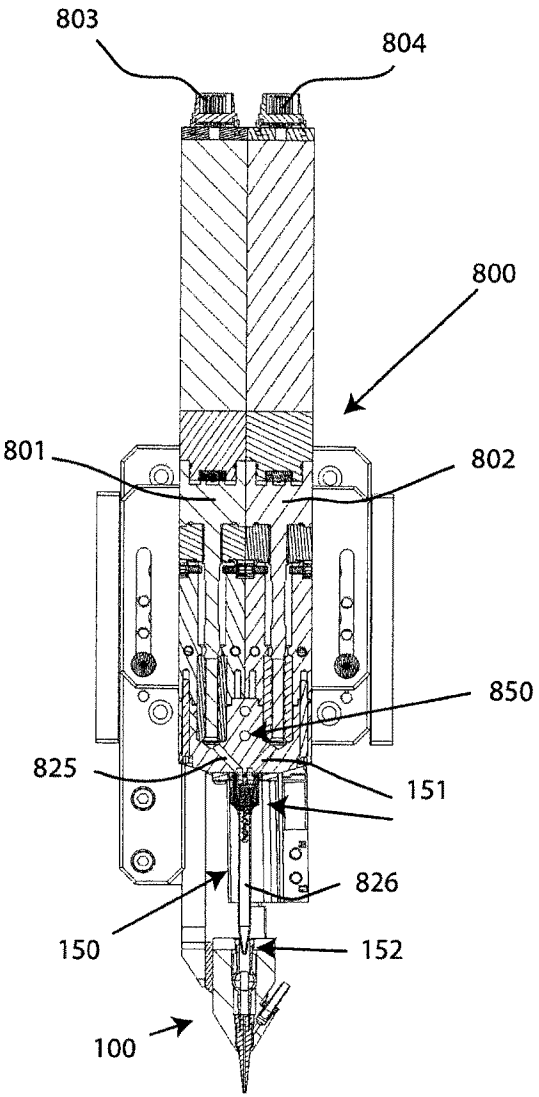
FIG. 2 depicts a cross-section view of an embodiment of the end effector including a feeding mechanism and a dispensing assembly.

Referring to the drawings, FIGS. 1 and 2 depict an embodiment of an end effector 1000. The end effector 1000 may be configured to be located within a machine or system having a frame, an X-axis actuator, a Y-axis actuator, and a Z-axis actuator. The machine housing or other component element(s) receiving the end effector 1000 may utilize a robotic platform to perform automated tasks with accuracy, precision, and repeatability. For example, the machine may be a Gantry robot having three principal axes (Cartesian coordinates) controlling linear motion, wherein the horizontal member(s) may be supported at both ends. The machine may also be any robotic manipulator such as a selective compliant assembly robot arm (SCARA) system, linear robot, multi-axis robot arm system, and the like. However, an embodiment of the machine will be described as utilizing a Gantry robot for exemplary purposes. The end effector 1000 may refer to any device(s) attached to a X, Y, Z or other axis of movement to perform a variety of tasks, such as dispensing, picking and placing, routing, and the like. For instance, the end effector 1000 is capable of rotation about the Z axis, and may move left and right along the Y axis by sliding along the Y axis actuator, and move back and forth along the X axis by sliding with the Y axis actuator as it slides along the X axis actuator. Additionally, the end effector 100 may move up and down on the Z-axis by sliding along the Z-axis actuator. The X-axis actuator, the Y-axis actuator, and the Z-axis actuator may be a ball screw slide, linear motion slide, a linear actuator, and the like. Moreover, the frame of the machine enclosing, housing, or otherwise receiving the end effector 100 (and potentially other end effectors) may provide a structure surrounding the components of the machine. The frame may allow for panels to be attached providing an enclosure for the machine. The panels attached to the frame may be a combination of both solid panels and see-through panels, such as Plexiglas®, glass, plastic, and the like, to allow viewing of the operation of the first machine 30.

Referring still to FIGS. 1 and 2, embodiments of the end effector 1000 may include a dispensing assembly 100 and a feeding mechanism 800. Embodiments of the dispensing assembly 100 may be a device, an apparatus, or system that is configured to dispense a surface, edge, and/or perimeter of a substrate for operable bonding of one or more surfaces or substrates, and will be described in greater detail infra. Embodiments of the fluid dispensed by the adhesive dispensing assembly 100 may be an adhesive, a thermoplastic adhesive, a component adhesive, a reactive adhesive, a mixed adhesive, or an optically clear adhesive, such as DuPont® Vertak family of adhesives. The dispensed fluid may be pumped, fed, delivered, or otherwise advanced towards a dispensing nozzle for dispensing onto a target. Embodiments of the dispensed fluid may first be fed into a mixing element 150 through operation of one or more pumps 801, 802 of a feeding mechanism 800.

Figure 3:
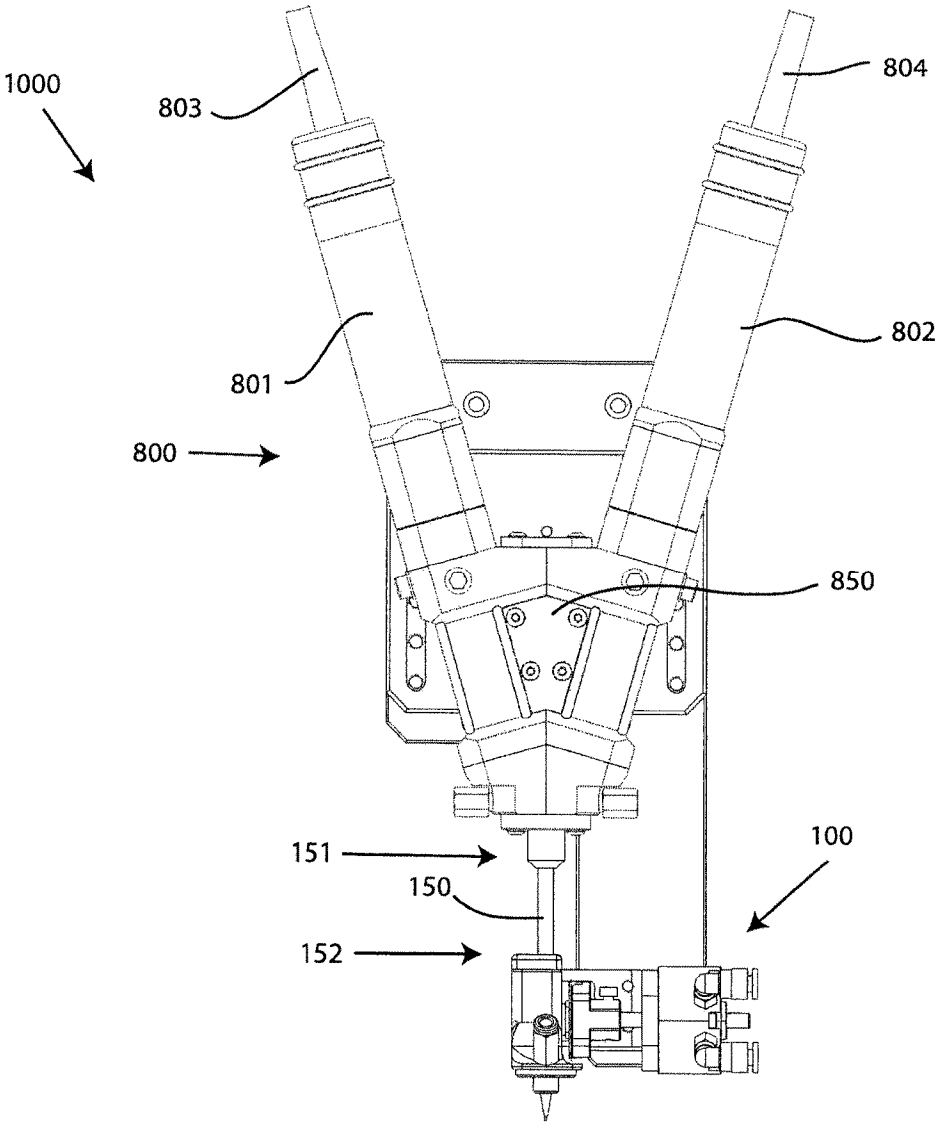
FIG. 3 depicts a front, perspective view of an alternative embodiment of a feeding mechanism.
Figure 4:
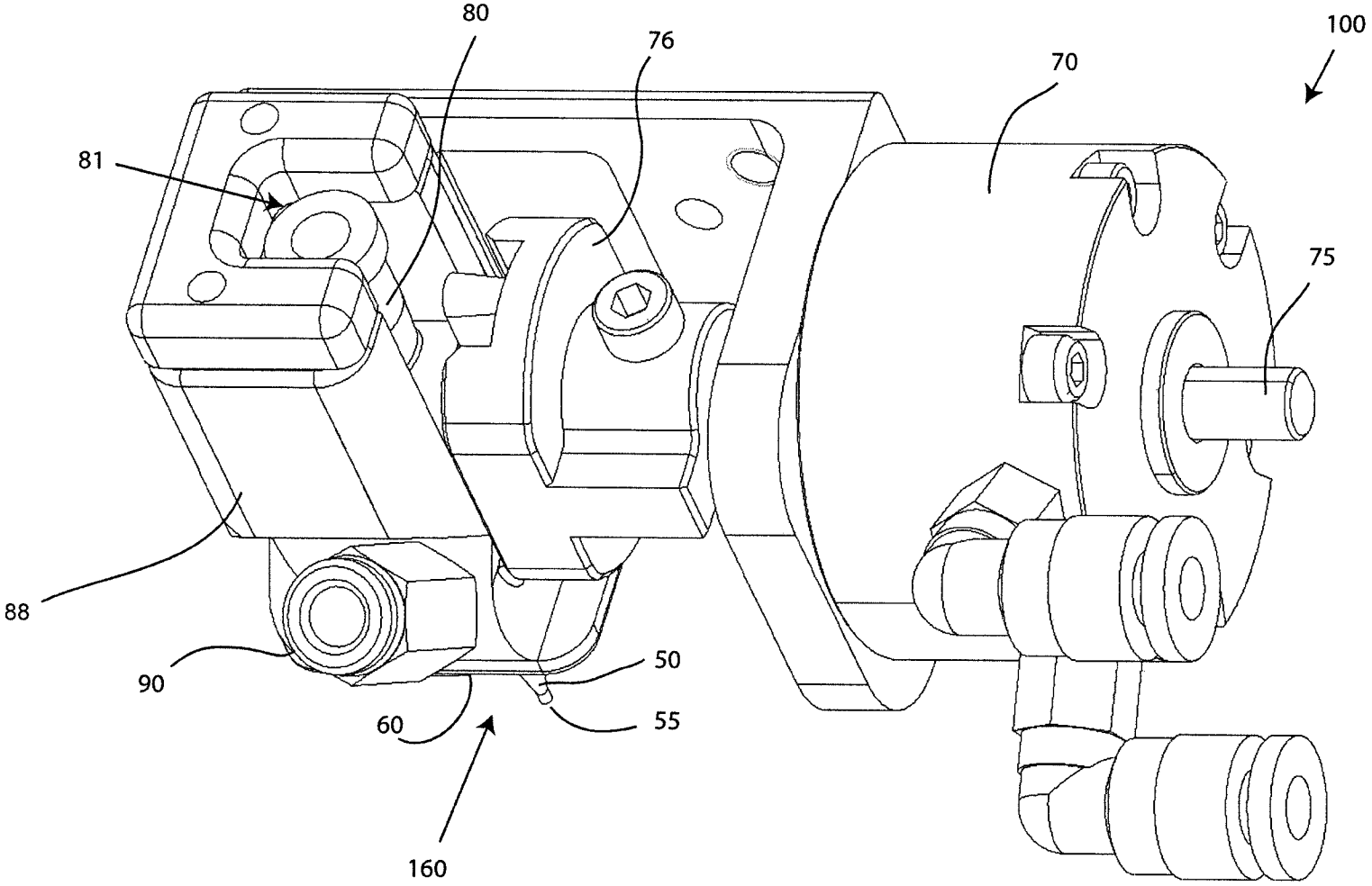
FIG. 4 depicts a perspective view of an embodiment of the dispensing assembly having a first embodiment of a blow-off mechanism.

Embodiments of the feeding mechanism 800 may be any mechanism that can deliver one or more dispensable fluids to the dispensing assembly 100. Embodiments of the feeding mechanism 800 may include one or more progressive cavity pumps to form a 2 part dispensing head. For example, embodiments of the feeding mechanism 800 may include one or more pumps 801, 801, and an electrical port 803, 804 associated with the pump 801, 802, respectively. In one embodiment, the pumps 801, 802 may be in a side-by-side or parallel arrangement. In another embodiment, the pumps 801, 802 may be in a V-shaped arrangement, as shown in FIG. 3. Moreover, embodiments of the feeding mechanism 800 may include a fluid body 850, wherein the fluid body 850 may be configured to operably receive a first end 151 of a mixing element 150. Embodiments of the fluid body 850 of the feeding mechanism 800 may include a first fluid path 825 and a second fluid path 826 for advancing a first and second dispensing fluid to the mixing element 150. Embodiments of the first and second fluid path 525, 526 may be a bore or similar opening in the fluid body 850 that, at one end is in fluid communication with a fluid source for receiving a fluid, such as an adhesive, and at the other end is in fluid communication with the mixing element 150. In other words, one or more dispensing fluids may be drawn, forced, or otherwise fed from a fluid source (e.g. via tube or hose connection to the source) through the first and/or second fluid path 525, 526 to the first end 151 of the mixing element 150 through operation of one or more pump, such as pumps 801, 802. In alternative embodiments, the fluid body 850 may be operably connected to an end of a syringe, cartridge, hose, tube, valve, or any device or physical pathway that facilitates the flow of a fluid, such as one or more adhesives, to the dispensing assembly 100. The components of the dispensing assembly 100 may be comprised of metal, plastic, composite, or a combination thereof.

Furthermore, embodiments of the feeding and dispensing assembly 1000 may further include a mixing element 150; the mixing element 150 may be a part or component of the feeding mechanism 800. Embodiments of the mixing element 150 may be operably connected to the feeding mechanism as shown in FIG. 2. In other words, the mixing element 150 may located or otherwise disposed between the fluid body 850 of the feeding mechanism 800 and the dispensing assembly 100. Embodiments of the mixing element 150 may have a first end 151, a second end 152, and an internal pathway 153 therebetween. Embodiments of the mixing element 150 may be a vessel or tube that is configured to receive one or more types of fluids, such as two reactive adhesives at a first end 151 from the feeding mechanism 800. For example, a first fluid may enter the mixing element 150 from the first fluid path 525 and a second fluid may enter the mixing element 150 from the second fluid path 526 for mixing and/or reaction with one another. The first fluid and the second fluid entering the mixing element 150 from the feeding mechanism 800 may be different fluids, similar fluids, the same fluids, and combination of fluids entering the mixing element 150 for further reaction and mixing. Embodiments of the mixing element 150 may be a static or dynamic mixer, and may be rigid or flexible. Once within the mixing element 150, the reactive adhesives may mix or otherwise react with each other and travel through the internal pathway 153 of the mixing element 150. The adhesives contained within the mixing element 150 may then exit the mixing element 150 through an opening at the second end 152. The second end 152 of the mixing element 150 may be operably connected to a flow control device 80 of the dispensing assembly 100.

Referring now to FIGS. 4-12, embodiments of the dispensing assembly 100 are depicted. Embodiments of the dispensing assembly may be configured to attach to end effector 100 for operable use. The dispensing assembly 100 may also cooperate with the feeding mechanism 800 to accurately, precisely, and repeatedly dispense a fluid onto a surface of a substrate. In some embodiments, the dispensing assembly 100 may be operably physically connected to a mixing element 150, which may be operably physically connected to the feeding mechanism 800. In other embodiment, the dispensing assembly 100 may be physically directly connected to the feeding mechanism 800, and may dispense a non-reacted or mixed fluid. Embodiments of the dispensing assembly 100 may be an adhesive dispenser, an adhesive dispensing head, an adhesive dispensing assembly, and the like. Furthermore, the dispensing assembly may have a body portion that may refer to a general frame or structure of the dispensing assembly 100. Embodiments of a blow-off mechanism 160 may be operably attached to the body portion of the dispensing assembly 100. Embodiments of the flow control device 80 may also be housed, disposed, and/or located within the body portion of the dispensing assembly.

Moreover, embodiments of the dispensing assembly 100 may include a flow control device 80, an actuator 70, a dispensing nozzle 50, and a cleaning mechanism 160. Embodiments of the adhesive dispensing assembly 100 may also include a flow control device 80 for controlling a flow of a fluid through a dispensing nozzle 50 and a mechanism for cleaning the dispensing nozzle 50 without operator intervention, wherein the mechanism for cleaning the dispensing nozzle 50 may include pressurized fluid, such as forced air, to remove a residue of the fluid from the dispensing nozzle 50.

Referring now to FIGS. 4-12, embodiments of the adhesive dispensing assembly 100 may include a flow control device 80, or on/off fluid flow control. Embodiments of the flow control device 80 may allow for precise amounts of dispensed fluid to exit the dispensing nozzle 50 because the flow control device 80 may be located just upstream, above, or otherwise proximate the dispensing nozzle 50. Embodiments of the flow control device 80 may be a stopcock or comparable valve or pump for controlling a flow of a fluid, such as one or more adhesives through an outlet 55 of a dispensing nozzle 50. In one embodiment, the fluid control device 80 may be a low cost, medical grade plastic stopcock. Embodiments of the flow control device 80, or the on/off fluid flow control, may reside within or be housed by enclosure 88. The enclosure 88 may be operably connected to a connecting plate 5 that may be configured to attach to a portion of the end effector 1000. Moreover, embodiments of the flow control device 80 may have a first end 81, a second end 82, and an internal bore 84 defined therebetween. The first end 81 of the flow control device 80 may be operably connected to the second end 152 of the mixing element 150. For instance, the first end 81 of the flow control device 80 may accept, receive, accommodate, etc., the second end 152 of the mixing element 150, which may include a tapered end for insertion within the internal bore 84 of the flow control device 80. Thus, the precise on/off control of the flow of the fluid may be accomplished by the flow control device 80 after mixing of the adhesives by the mixing element 150 and just prior to exiting the dispensing nozzle 50 for dispensing onto a substrate or other target. The second end 82 of the flow control device 80 may be configured to be equipped with the dispensing nozzle 50, which may be a disposable nozzle. For instance, the dispensing nozzle 50 may be press-fit, threaded, or otherwise attached to the second end 82 of the flow control device 80. Furthermore, embodiments of the internal bore 84 may be a channel, a pathway, a tunnel, or axial opening between the first end 81 and the second end 82 of the flow control device 80; there may be an opening somewhere along the internal bore 84 for a flow regulator 85 to reside therein and be operably connected to a control switch 86 of the flow control device 80.

Figure 12:
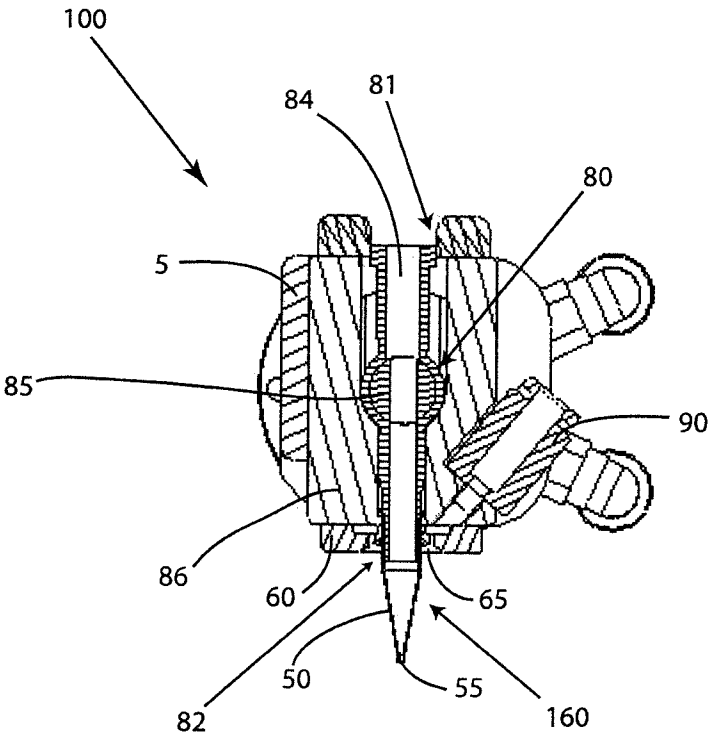
FIG. 12 depicts a cross-sectional view of an embodiment of the flow control device of the dispensing assembly.

Embodiments of the flow control device 80 may be actuated by an actuator 70. Embodiments of the actuator 70 may be a linear actuator, a mechanical actuator, a hydraulic actuator, an electro-mechanical actuator, an electric motor, and the like. Embodiments of the actuator 70 of the dispensing assembly 100 may include a shaft 75 and an actuator head 76. Embodiments of the actuator head 76 may be configured to mechanically engage a control switch 86 of the flow control device 80 when actuated by the actuator 70 to physically turn or otherwise operate or impact the control switch 86. Embodiments of the control switch 86 may be a part of and/or connected to a flow regulator 85 that physically blocks a pathway making up the internal bore 84 of the flow control device 80; the flow regulator 85 may be a plastic or solid member that moves from an open position (as shown in FIG. 12) to a closed position within the internal bore 84 when the control switch 86 is operated. Thus, the actuator 70 may operate to actuate or rotate the actuator head 76 to engage and operate the control switch 86 to physically move the flow regulator 85 within the internal bore 84 from an open position to a closed position, and vice versa, to start and stop the flow the fluid through the flow control device 80. Because the dispensing nozzle 50 can be operably attached to the second end 82 of the flow control device 80, precise on/off control of the flow of the fluid proximate the dispensing nozzle 50 can be achieved. For instance, starting and stopping of the flow near the dispensing nozzle 50 may allow for precise starts and stops, and provides for a smaller volume of fluid remaining between the location of the shut-off and an outlet. Embodiments of the actuator 70 may be a rotary valve, such as a pneumatic rotary valve, but may also be servo controlled. In other embodiments, the flow control device 80 may be actuated by a linear actuator, wherein the linear actuator may also be pneumatic or servo controlled.

Embodiments of the adhesive dispensing assembly 100 may further include a dispensing nozzle 50. Embodiments of the dispensing nozzle 50 may be disposed at the second end 82 of the flow control device 80 for dispensing or otherwise exiting a fluid, such as an adhesive or a mixture of adhesives. Embodiments of the dispensing nozzle 50 may be a core, a dispense core, a dispensing member, a Luer dispense nozzle, a dispense tip, a tip, a cone, a dispense cone, a tapered dispense tip, a dispensing needle, and the like, and may be comprised of a plastic, metal, or a combination of metal and plastic. Moreover, embodiments of the dispensing nozzle 50 may include an outlet 55. The outlet 55 may be an orifice, an opening, an aperture, or exit for an amount of the fluid passing though the dispensing assembly 100. For example, when the flow control device 80 is moved to an open position (e.g. through pneumatic actuation of an actuator 70 to operate a control switch 86 to turn the flow regulator 85 within the internal bore 84 to a parallel type position with respect to the pathway defined by the internal bore 84), the fluid may exit the outlet of the dispensing nozzle 50 onto a surface or substrate. When the flow control device 80 is moved to a closed position (e.g. through pneumatic actuation of an actuator 70 to operate a control switch 86 to turn the flow regulator 85 within the internal bore 84 to a perpendicular type position with respect to the pathway defined by the internal bore 84), the flow of the fluid may be stopped and the fluid may stop exiting the outlet 55 of the dispensing nozzle 50. Because the actuator 70 may be pneumatic or servo controlled, the stopping and starting of the fluid exiting the outlet of the dispensing nozzle 50 may be precise and account for various fill patterns. Accordingly, the on/off control of the flow of the fluid may be accomplished after mixing of the adhesives by the mixing element 150, or structurally below the mixing element 150 or closer to the surface intended to receive the adhesive, through the use of a disposable stopcock actuated by an actuator 70 or linear actuator, both of which may either be pneumatic or servo controlled.

With reference now to FIGS. 4-12, embodiments of the dispensing assembly 100 may also include a mechanism for cleaning the dispensing nozzle 50. The mechanism for cleaning the dispensing nozzle 50 may include a blow-off mechanism 160 that is configured to clean, wipe away, remove, etc., a tip of the dispensing nozzle 55 proximate, at, or otherwise near the outlet 55 without any operator intervention or need to physically relocate and/or displace the nozzle 50. For instance, instead of physically moving the nozzle tip to a purge cup or using a wiper or cloth to clean the nozzle tip, the end effector 1000 (or nozzle 50) may remain in the same location or begin moving to the next programmed location while the blow-off mechanism 160 cleans the tip of the nozzle 50. Embodiments of the blow-off mechanism 160 may be a blow-off device, a cleaning mechanism, a removal means, a tip cleaning system, and the like. Embodiments of the blow-off mechanism may include a cap member 60 around dispensing nozzle 50 that may allow and/or facilitate the passage of a fluid from a source to the nozzle 50 to blow-off, remove, clean, etc. a remaining fluid residue that may gather, exist, remain, build-up, etc., at, on, or near the outlet 55 of the dispensing nozzle 50 after a dispensing cycle. The blow-off mechanism 160 may begin operation while the fluid (e.g. adhesive(s)) is not continuously exiting the outlet 55 of the nozzle 50. In other words, as the fluid control device 80 moves to a closed position, the fluid may stop continuously exiting the outlet 55 and the blow-off mechanism 160 may activate and force a fluid towards the outlet 55 around the dispensing nozzle 50 to blow away or remove a dispensed fluid residue that could otherwise create a blockage and/or imperfect dispensing profiles that could sacrifice precision in a situation where precision may be required. Furthermore, embodiments of the blow-off mechanism may utilize compressed air forced through one or more openings in the cap member 60 of the dispensing assembly 100 to clean or blow-off dispensed fluid residue located at or near the nozzle. For instance, a fluid source, such as an air compressor, may provide compressed air (e.g. 80 psi) via a connection line (e.g. tube or line that may rigid or flexible) coupled to an inlet port 90 and then through the cap member 60 to target a tip of the nozzle 50 while the dispensing fluid is not actively exiting the outlet 55 of the nozzle. However, embodiments of the blow-off mechanism may utilize other fluids to clean the nozzle tip. For example, embodiments of the blow-off mechanism may force a solvent or cleaning fluid through the cap member 60 to clean or remove a dispensing fluid residue from the outlet 55 of the nozzle 50.

Figure 5:
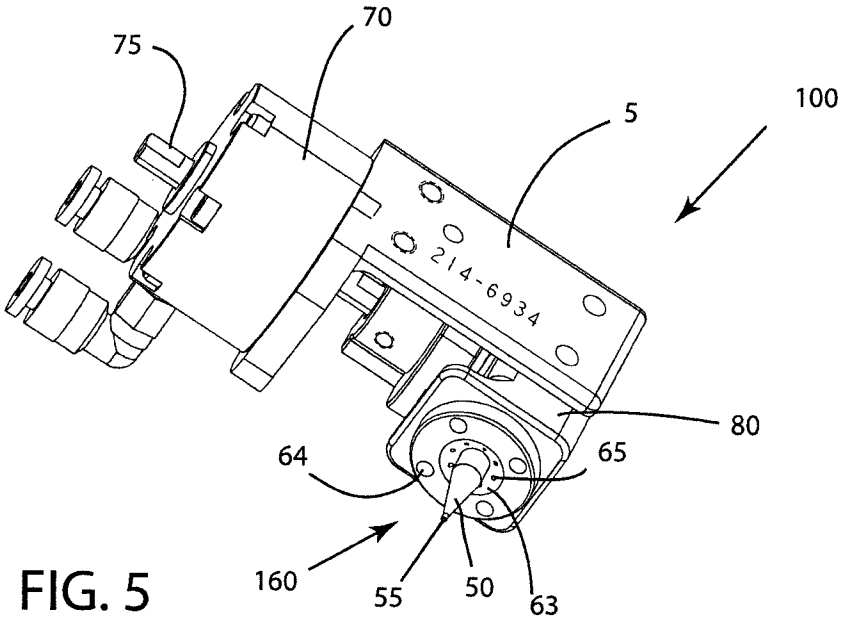
FIG. 5 depicts a first bottom, perspective view of an embodiment of the dispensing assembly having the first embodiment of the blow-off mechanism.
Figure 6:
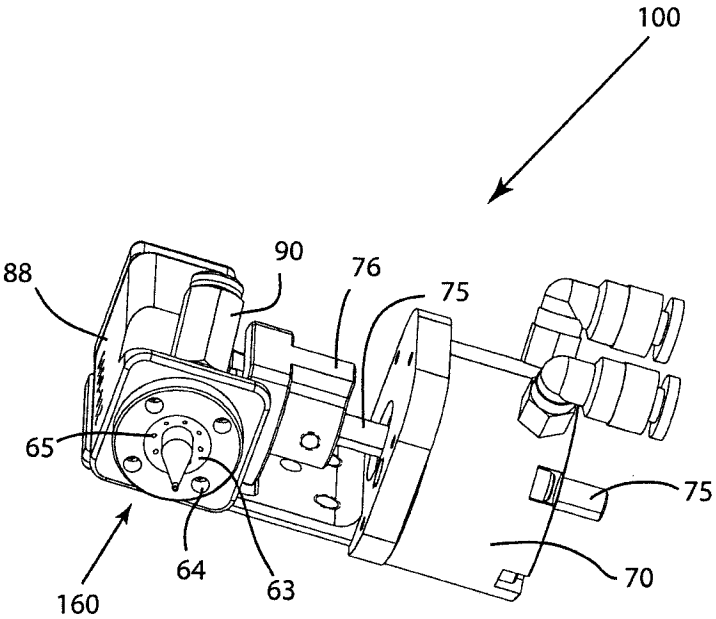
FIG. 6 depicts a second bottom, perspective view of an embodiment of the dispensing assembly having the first embodiment of the blow-off mechanism.
Figure 8:
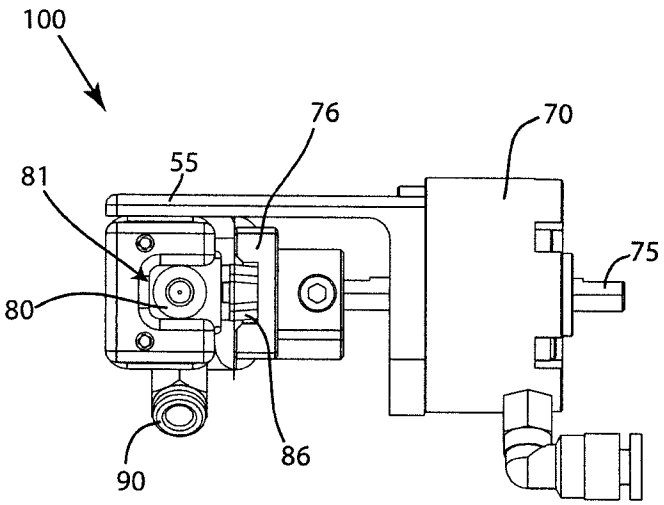
FIG. 8 depicts a top view of an embodiment of the dispensing assembly having the first embodiment of the blow-off mechanism.
Figure 7:
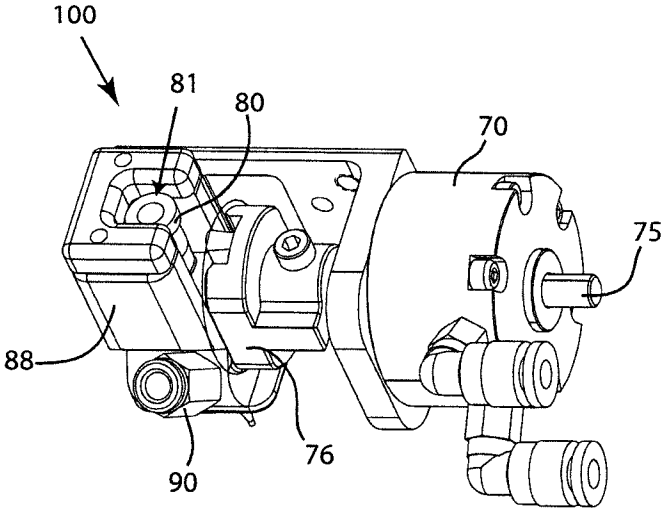
FIG. 7 depicts a top, perspective view of an embodiment of the dispensing assembly having the first embodiment of the blow-off mechanism.
Figure 10:
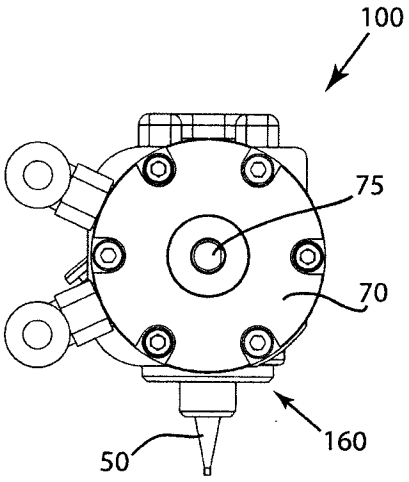
FIG. 10 depicts a right side view of an embodiment of the dispensing assembly having the first embodiment of the blow-off mechanism.
Figure 9:
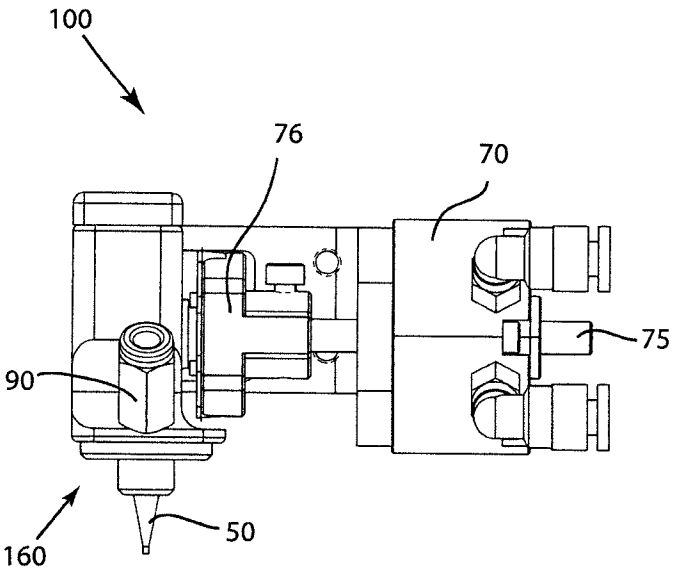
FIG. 9 depicts a front view an embodiment of the dispensing assembly having the first embodiment of the blow-off mechanism.
Figure 11:
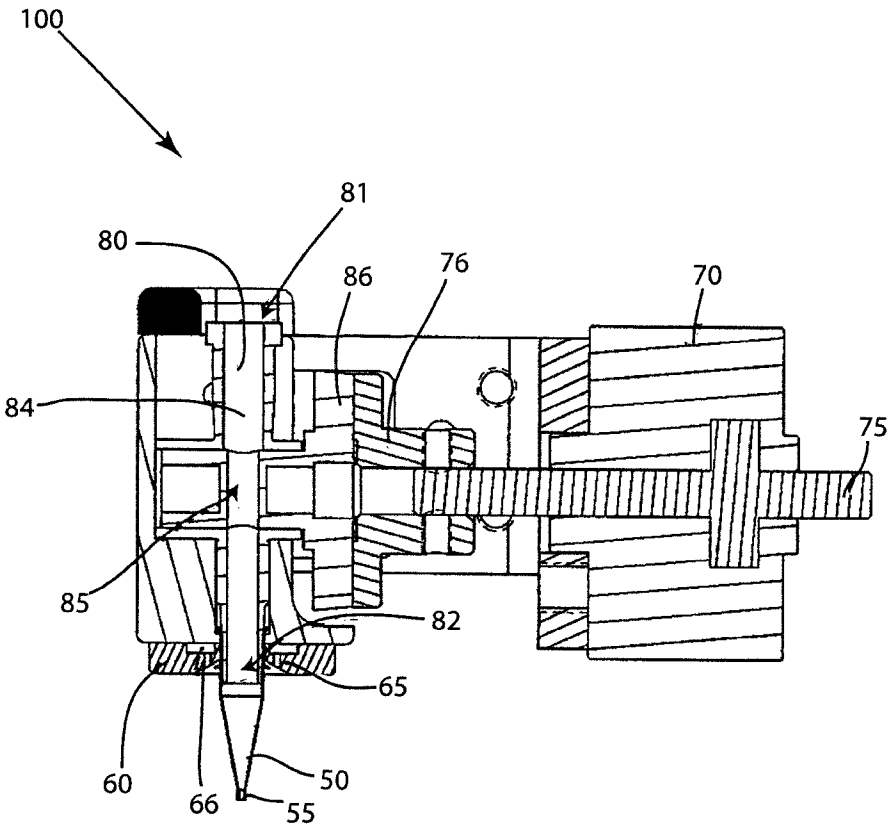
FIG. 11 depicts a cross-sectional view of an embodiment of the dispensing assembly having the first embodiment of the blow-off mechanism.

Referring to FIGS. 5 and 6, embodiments of the dispensing assembly 100 may include a cap member 60, wherein the cap member 60 may include a central opening for the dispensing nozzle 50. Embodiments of the cap member 60 may be a fluid chamber housing that receives the fluid from a fluid fitting 90. Embodiments of the cap member 60 may be operably connected to the structure 88 that surrounds or partially surrounds the flow control device 80. In one embodiment, the cap member 60 may be attached to the structure 88 by fastening the cap member 60 to the structure using one or more fastening device(s) 64. Fastening devices 64 may be screw that passes through an opening on the cap member 60 and threadably received by corresponding openings on the structure 88. Moreover, embodiments of the cap member 60 may be disc-shaped to provide 360° coverage around the dispensing nozzle 50; however, those having skill in the art should appreciate that the cap member 60 may be rectangular or other shape. Moreover, embodiments of the cap member 60 may include an internal fluid chamber 66, as shown in FIG. 11. A fluid may be introduced to the internal fluid chamber 66 through a fluid fitting, such as inlet port 90. For instance, a hose or line may be coupled to the fluid fitting 90 to force or otherwise deliver a fluid into the internal fluid chamber 66; the fitting 90 may include a bore or fluid pathway into the air chamber 66. Embodiments of the cap member 60 may also include a recessed surface 63, wherein a plurality of fluid jets 65 may be located. Embodiments of the recessed surface 63 may be tapered or stepped. Embodiments of the fluid jets 65 may be positioned along the recessed surface 63 of the cap member 60 and can be in fluid communication with the internal fluid chamber 66. For instance, the fluid jets 65 may be openings, tunnels, channels, fluid pathways, holes, openings, and the like, that may interconnect the internal fluid chamber 66 with the environment surrounding the dispensing nozzle 50, and may be configured to blow a fluid, such as compressed air, onto the dispensing nozzle 50. The fluid introduced into the internal fluid chamber 66 may exit through one or more of the fluid jets 65, and the fluid exiting the jets 65 may be focused, aimed, targeted, oriented, aligned, etc., to blow towards the outlet 55 of the dispensing nozzle 50 and remove and or clean off dispensed fluid residue from the outlet 55 of the dispensing nozzle 50. In one embodiment, once the fluid pathway is closed by the flow control device 80, or the fluid flow is turned off, fluid may be forced into the fluid chamber 66 through the fitting 90 and out through the jets 65 with enough velocity to disperse an amount of residual adhesive from the outlet 55 and/or outer surface of the dispensing nozzle 50. In this embodiment, no operator involvement is necessary to clean the dispensing nozzle 50 and/or outlet 55 because the exiting fluid cleans the nozzle 50.

Figure 14:
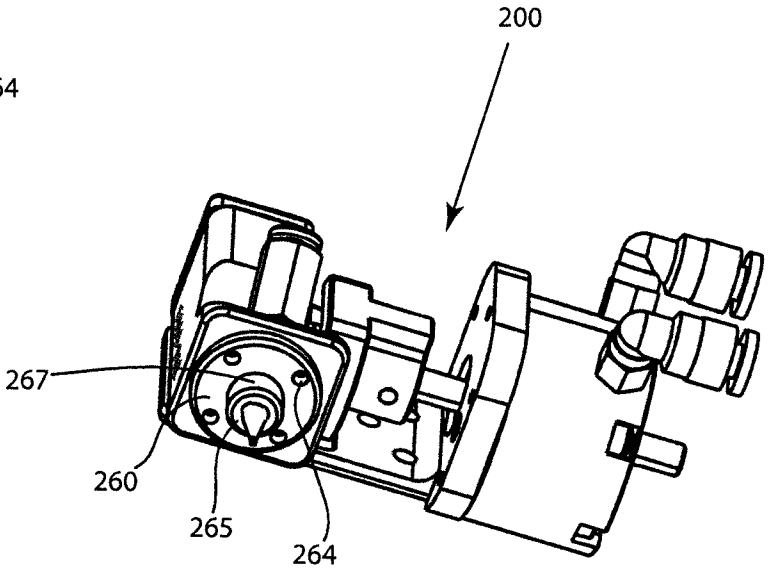
FIG. 14 depicts a second bottom, perspective view of an embodiment of the dispensing assembly having the second embodiment of the blow-off mechanism.
Figure 13:
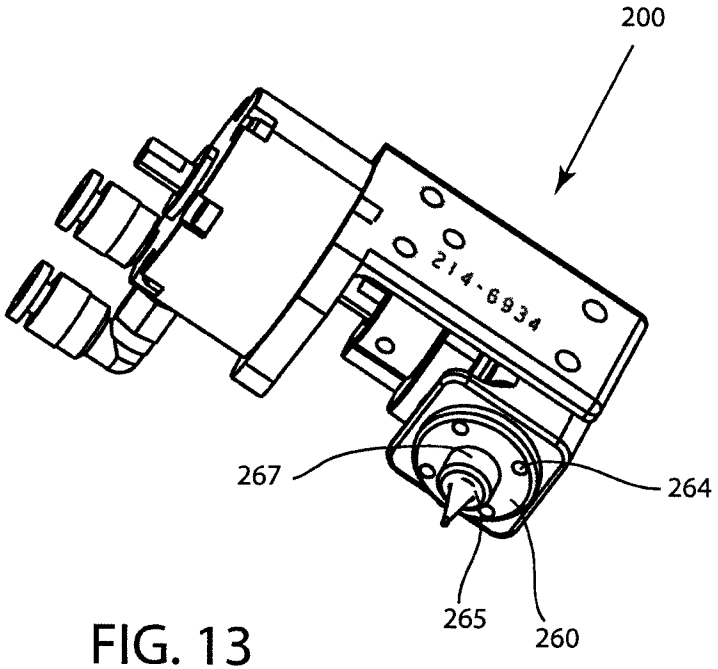
FIG. 13 depicts a first bottom, perspective view of an embodiment of the dispensing assembly having a second embodiment of the blow-off mechanism.
Figure 15:
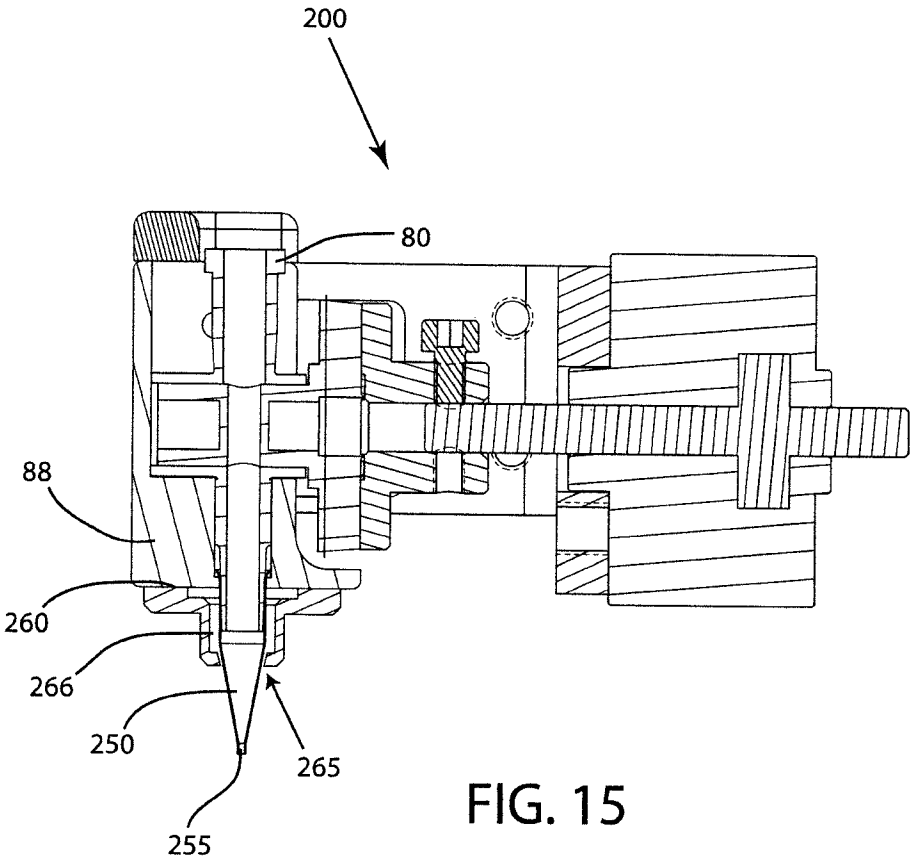
FIG. 15 depicts a cross-sectional view of an embodiment of the dispensing assembly having the second embodiment of the blow-off mechanism.
Figure 16:
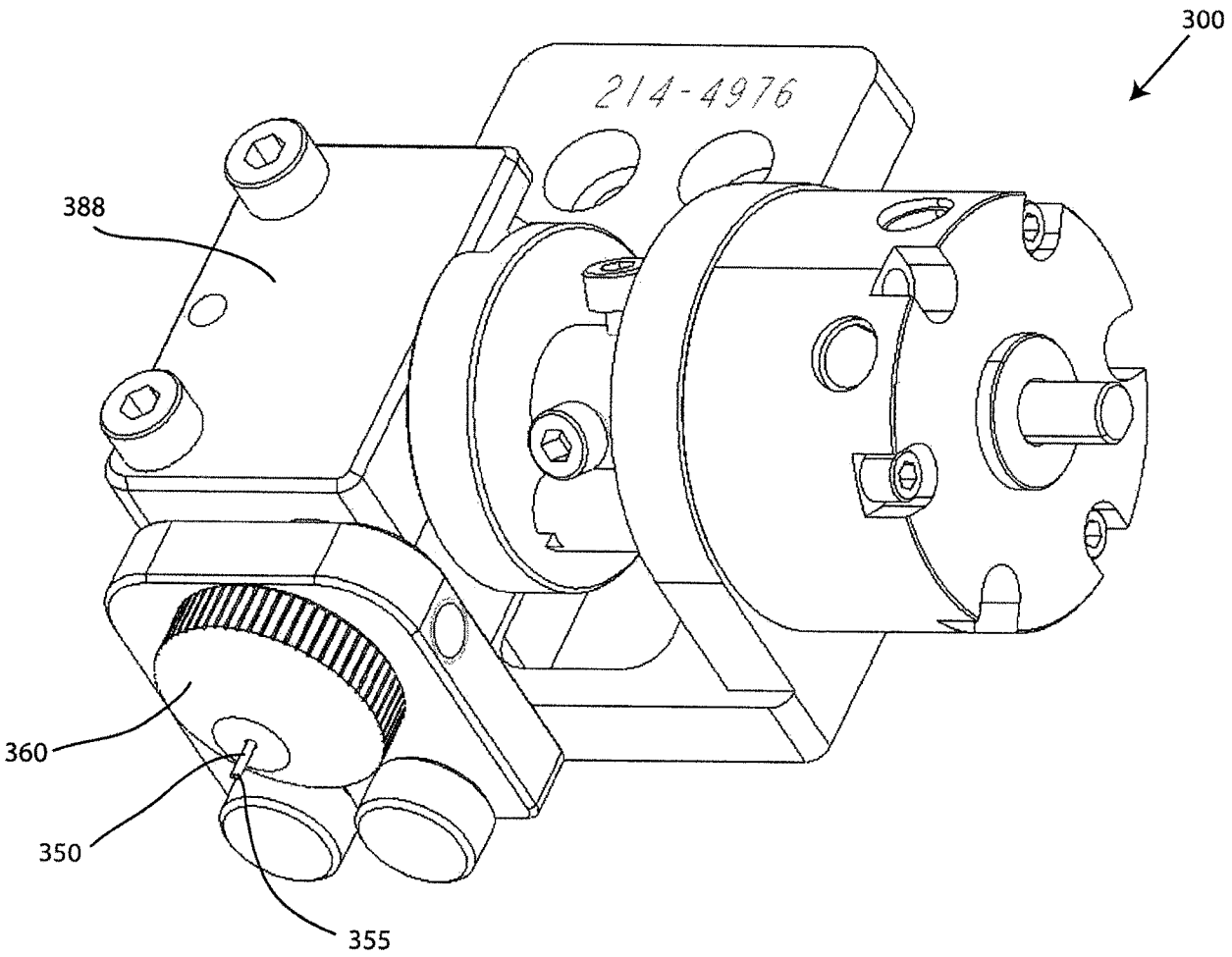
FIG. 16 depicts a perspective view of an embodiment of the dispensing assembly having a third embodiment of a blow-off mechanism.
Figure 18:
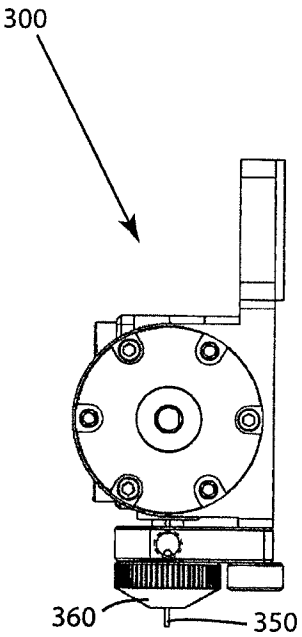
FIG. 18 depicts a right side view of an embodiment of the dispensing assembly having the third embodiment of a blow-off mechanism.
Figure 17:
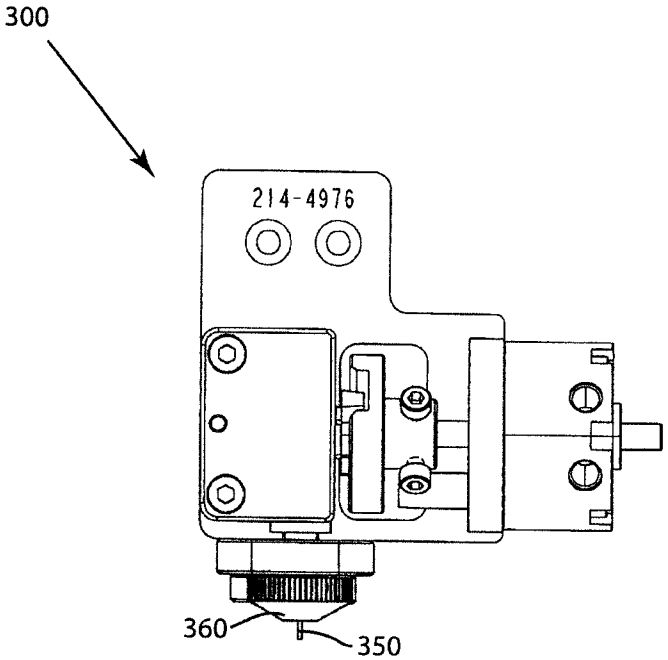
FIG. 17 depicts a rear view of an embodiment of the dispensing assembly having the third embodiment of a blow-off mechanism.

Referring now to FIGS. 13-15, an embodiment of a dispensing assembly 200 is depicted. Embodiments of the assembly dispensing assembly 200 may share the same or substantially the same structural and functional aspects of the dispensing assembly 100, but may include a different structure as a means or mechanism for cleaning the dispensing nozzle 250. For instance, embodiments of the dispensing assembly 200 may include a cap member 260 that may be operably connected to a structure 88 that surrounds or partially surrounds the flow control device 80, such as through fastening device(s) 264. Embodiments of the cap member 260 may be disc-shaped to provide 360° coverage around the dispensing nozzle 250; however, those having skill in the art should appreciate that the cap member 260 may be rectangular or other shape. Embodiments of the cap member 260 may include a neck portion 267 that may extend from the cap member 260. Moreover, embodiments of cap member 260 may include an internal fluid chamber 266, as shown in FIG. 15. A fluid, such as compressed air, may be introduced to the internal fluid chamber 266 through fluid fitting 290. For instance, a hose or line may be coupled to the air fitting 290 to force fluid into the internal fluid chamber 266. A small gap 265 may exist between the cap member 260, in particular, the neck portion 267 of the cap member 260, and the outer surface of the dispensing nozzle 250 to allow the exit of the fluid from the cap member 266. Embodiments of the small gap 265 may be an opening, a slot, an aperture, and the like, and may partially or completely surround or encircle the dispensing nozzle 250. The fluid introduced into the fluid chamber 266 may exit through the small gap 265. The fluid exiting the gap 265 may be focused to blow towards the outlet 255 of the dispensing nozzle 250 and remove or blow-off a dispensed fluid residue from the outlet 255 and/or the outer surface of the dispensing nozzle 250. In one embodiment, once the fluid pathway is closed in the flow control device 80, or the fluid flow is turned off, fluid, such as compressed or forced air may be forced or otherwise delivered into the fluid chamber 266 through the fitting 290 and out through the gap 265 with enough velocity to disperse or blow-off an amount of residual adhesive from the outlet 255 and/or the dispensing nozzle 250. In this embodiment, no operator involvement is necessary to clean the dispensing nozzle 250 and/or outlet 255 because the forced fluid cleans the nozzle 250.

Figure 19:
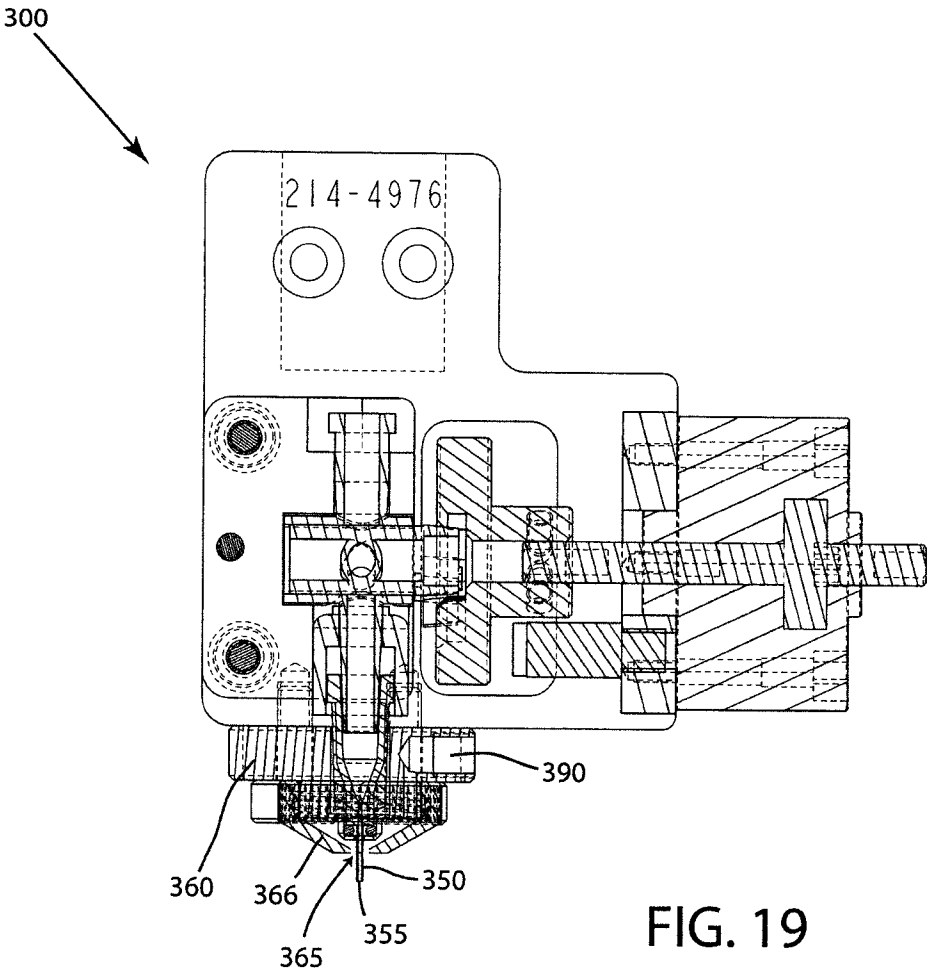
FIG. 19 depicts a cross-sectional view of an embodiment of the dispensing assembly having the third embodiment of a blow-off mechanism.
Figure 20:
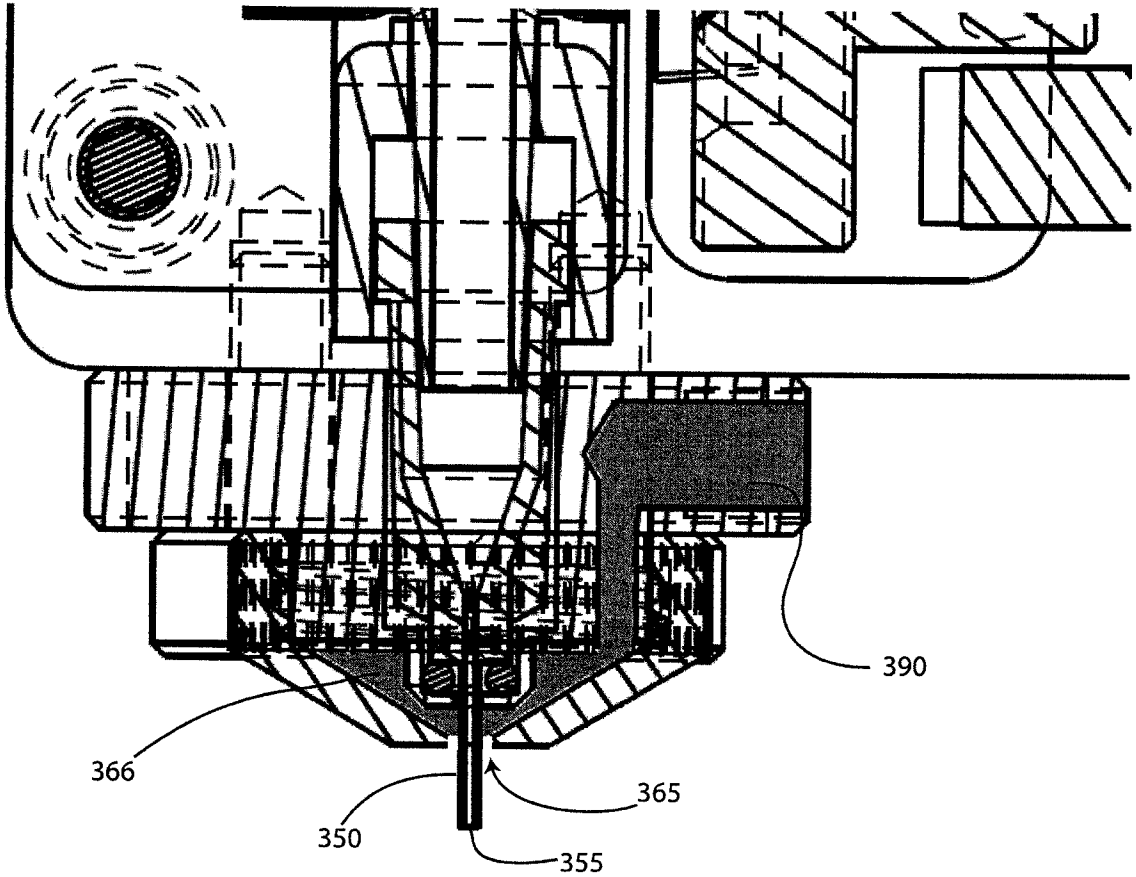
FIG. 20 depicts an enlarged cross-sectional view of the third embodiment of a blow-off mechanism.

With reference now to FIGS. 16-20, embodiments of dispensing assembly 300 is depicted. Embodiments of the assembly dispensing assembly 300 may share the same or substantially the same structural and functional aspects of the adhesive dispensing assembly 100, 200, but may include a different structure as a means or mechanism for cleaning the dispensing nozzle 350, wherein the dispensing nozzle 350 is a dispensing needle. For instance, embodiments of the dispensing assembly 300 may include a cap member 360 may be operably connected to a structure 88 that surrounds or partially surrounds the flow control device 80, such as through fastening device(s). Embodiments of the cap member 360 may be disc-shaped to provide 360° coverage around the dispensing nozzle 350; however, those having skill in the art should appreciate that the cap member 360 may be rectangular or other shape. Moreover, embodiments of cap member 360 may include an internal fluid chamber 366, as shown in FIGS. 19 and 20. A fluid may be introduced to the internal fluid chamber 366 through fluid bore 390, as shown in FIGS. 19 and 20. For instance, a hose or line may be coupled to or in fluid communication with the fluid bore 390 to force or otherwise deliver a fluid, such as compressed air, into the internal fluid chamber 366. A small gap 365 may exist between the cap member 360 and the outer surface of the dispensing nozzle 350 to allow the exit of fluid from the fluid chamber 366. Embodiments of the small gap 365 may be an opening, a slot, an aperture, and the like, and may partially or completely surround or encircle the dispensing nozzle 350. Fluid introduced into the fluid chamber 366 may exit through the small gap 365. The fluid exiting the gap 365 may be focused to blow towards the outlet 355 of the dispensing nozzle 350 and remove or blow-off a dispensed fluid residue from the outlet 355 and/or the dispensing nozzle 350. In one embodiment, once the fluid pathway is closed in the flow control device 80, or the fluid flow is turned off, fluid may be forced or otherwise delivered into the fluid chamber 366 through the fluid bore 390 and out through the gap 365 with enough velocity to disperse or blow-off an amount of residual adhesive from the outlet 355 and/or the dispensing nozzle 350. In this embodiment, no operator involvement is necessary to clean the dispensing nozzle 350 and/or outlet 355 because the exiting fluid cleans the nozzle 350.

Figure 22:
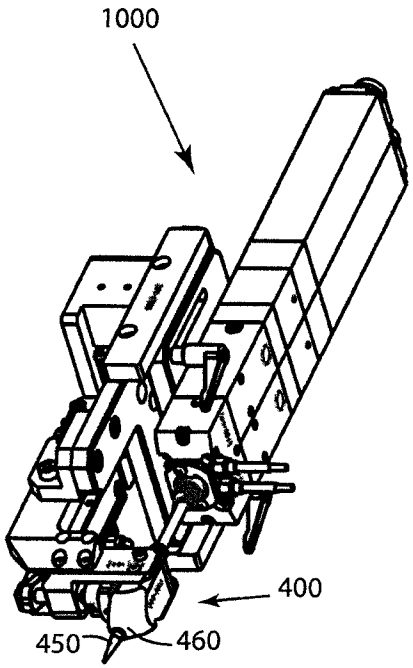
FIG. 22 depicts a front, perspective view of an embodiment of the dispensing assembly having the fourth embodiment of the blow-off mechanism.
Figure 21:
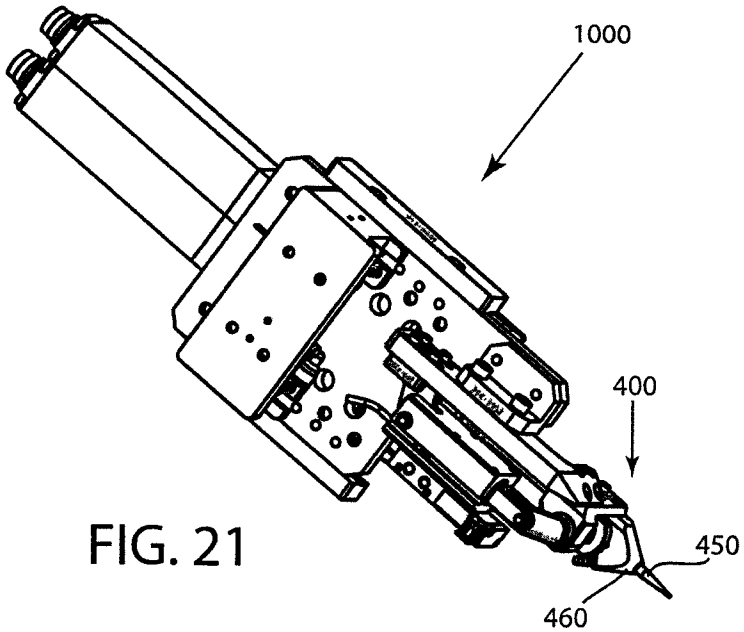
FIG. 21 depicts a rear, perspective view of an embodiment of the dispensing assembly having a fourth embodiment of the blow-off mechanism.
Figure 23:
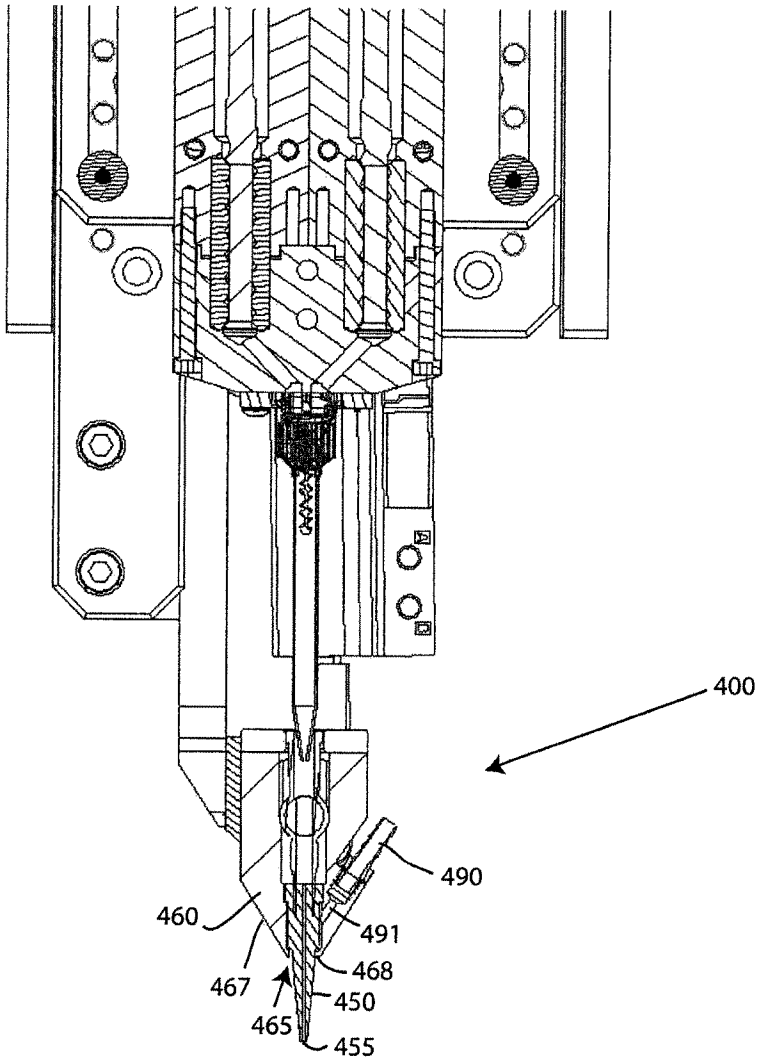
FIG. 23 depicts a cross-sectional view of an embodiment of the dispensing assembly having the fourth embodiment of the blow-off mechanism.

With continued reference to the drawings, FIGS. 21-23 depict an embodiment of dispensing assembly 400. Embodiments of the assembly dispensing assembly 400 may share the same or substantially the same structural and functional aspects of the dispensing assembly 100, 200, 300 but may include a different structure as a means or mechanism for cleaning the dispensing nozzle 450. For instance, embodiments of the dispensing assembly 400 may include a cap member 460 that may be operably connected to a structure that surrounds or partially surrounds the flow control device 80, such as through fastening device(s). Alternatively, embodiments of the cap member 460 may directly surround or partially surround the flow control device 80. Embodiments of the cap member 460 may provide 360° coverage around the dispensing nozzle 450. Embodiments of the cap member 460 may include a tapered portion 467 that may taper toward the dispensing nozzle 450. Moreover, embodiments of cap member 460 may receive a fluid, such as compressed air, through fluid fitting 490 and corresponding pathway 491. For instance, a hose or line may be coupled to the air fitting 490 to force fluid through the pathway 491. A small gap 465 may exist between the cap member 460, in particular, the tapered portion 467 of the cap member 460, and the outer surface of the dispensing nozzle 450 to allow the exit of the fluid from the cap member 460. Embodiments of the small gap 465 may be an opening, a slot, an aperture, and the like, and may partially or completely surround or encircle the dispensing nozzle 450. The fluid introduced through the inlet port 490 may exit through the small gap 465. The fluid exiting the gap 465 may be focused to blow towards the outlet 455 of the dispensing nozzle 450 and remove or blow-off a dispensed fluid residue from the outlet 455 and/or the outer surface of the dispensing nozzle 450. Further embodiments of the cap member 460 may include an internal lip 468 that inwardly extends from the cap member 460 towards the nozzle 450. The presence of the internal lip 468 may reduce the gap 465, which may help increase the velocity of the exiting fluid, and may also assist in the targeting and/or aiming of the exiting fluid. In one embodiment, once the fluid pathway is closed in the flow control device 80, or the fluid flow is turned off, fluid, such as compressed or forced air may be forced or otherwise delivered through the fitting 490 and out through the gap 465 with enough velocity to disperse or blow-off an amount of residual adhesive from the outlet 455 and/or the dispensing nozzle 450. In this embodiment, no operator involvement is necessary to clean the dispensing nozzle 450 and/or outlet 455 because the forced fluid cleans the nozzle 450.

With reference now to FIGS. 1-23, a method may include the steps of controlling the flow of a fluid in an adhesive dispensing assembly 100, 200, 300, 400 at a location proximate a dispensing nozzle 50, 250, 350, 450 such as at an end of a mixing element 150 or below a mixing element 150, and cleaning the dispensing nozzle 50, 250, 350, 450 by blowing off any dispensed fluid residue from the dispensing nozzle 50, 250, 350, 450 with a fluid. The fluid may be compressed air supplied by an air compressor, or may be a solvent or cleaning liquid. The fluids may be used interchangeably depending on the application.

While this disclosure has been described in conjunction with the specific embodiments outlined above, it is evident that many alternatives, modifications and variations will be apparent to those skilled in the art. Accordingly, the preferred embodiments of the present disclosure as set forth above are intended to be illustrative, not limiting. Various changes may be made without departing from the spirit and scope of the invention, as required by the following claims. The claims provide the scope of the coverage of the invention and should not be limited to the specific examples provided herein.

What is claimed is:

1. A dispensing assembly comprising:

a body portion; and a blow-off mechanism operably attached to the body portion, the blow-off mechanism including a cap member surrounding a dispensing nozzle such that a gap is formed directly between the cap member and the dispensing nozzle that defines a flow path for a fluid to flow between the cap member and the dispensing nozzle, the dispensing nozzle configured to continuously dispense a dispensing fluid through an outlet of the dispensing nozzle onto a substrate during a first operation;

wherein, in response to stopping the first operation, the fluid is forced through the gap along the flow path in a second operation to blow-off a dispensed fluid residue that has accumulated on a tip of the dispensing nozzle as a result of the first operation.

2. The dispensing assembly of claim 1, wherein the blow-off mechanism cleans the tip of the dispensing nozzle so that the tip is cleaned without any operator intervention to clean the tip of the dispensing nozzle.

3. The dispensing assembly of claim 1, wherein an inlet port is located on the body portion, the inlet port being in fluid communication with an internal fluid chamber located within the cap member, the gap being in fluid communication with the internal fluid chamber.

4. The dispensing assembly of claim 3, wherein the inlet port is configured to receive a line from a fluid source.

5. The dispensing assembly of claim 1, wherein the body portion is configured to receive an end of a mixing element, wherein the mixing element is configured to mix the dispensing fluid received from a feeding mechanism.

6. The dispensing assembly of claim 1, wherein the dispensing fluid is a component adhesive.

7. The dispensing assembly of claim 1, wherein the fluid is a pressurized gas.

8. A dispensing assembly comprising:

a flow control device for stopping and starting a continuous flow of a dispensing fluid through a dispensing nozzle, the flow control device disposed within a body portion of the dispensing assembly; and a mechanism for cleaning the dispensing nozzle, the mechanism for cleaning the dispensing nozzle being stationary with respect to the body portion of the dispensing assembly while in operation;

wherein the mechanism for cleaning the dispensing nozzle includes a blow-off mechanism operably attached to the body portion, the blow-off mechanism including a cap member surrounding a dispensing nozzle such that a gap is formed directly between the cap member and the dispensing nozzle that defines a flow path for a fluid to flow between the cap member and the dispensing nozzle, the dispensing nozzle configured to continuously dispense a dispensing fluid through an outlet of the dispensing nozzle onto a substrate during a first operation;

wherein, in response to stopping the first operation, the fluid is forced through the gap in a second operation to blow-off a dispensed fluid residue that has accumulated on a tip of the dispensing nozzle as a result of the first operation;

wherein the dispensing fluid passes through a different outlet than the fluid flowing from the one or more openings of the blow-off mechanism.

9. The dispensing assembly of claim 8, wherein the tip of the dispensing nozzle is cleaned while the dispensing fluid is not exiting an outlet of the dispensing nozzle.

10. The dispensing assembly of claim 8, wherein an inlet port is located on the body portion, the inlet port being in fluid communication with an internal fluid chamber located within a cap member of the blow-off mechanism, the gap being in fluid communication with the internal fluid chamber.

11. The dispensing assembly of claim 10, wherein the inlet port is configured to receive a line from a fluid source.

12. The dispensing assembly of claim 8, wherein the body portion is configured to receive an end of a mixing element, wherein the mixing element is configured to mix the dispensing fluid received from a feeding mechanism.

13. The dispensing assembly of claim 8, wherein the dispensing fluid is a component adhesive.

14. An end effector configured to attach to a Y axis actuator for moving along a Y axis and a X axis actuator for moving along an X axis, the end effector comprising:

a feeding mechanism, the feeding mechanism having a first fluid pathway and a second fluid pathway for advancing a first fluid and a second fluid;

a mixing element having a first end and a second end, the first end operably connected to the feeding mechanism, wherein the mixing element is configured to receive the first fluid and the second fluid; and a dispensing assembly having a dispensing nozzle, the dispensing assembly receiving the second end of the mixing element, wherein the dispensing assembly includes a blow-off mechanism having a cap member surrounding a dispensing nozzle such that a gap is formed directly between the cap member and the dispensing nozzle that defines a flow path for a fluid to flow between the cap member and the dispensing nozzle, the blow-off mechanism configured to blow-off a dispensed fluid residue that has accumulated on a tip of the dispensing nozzle after a continuous dispensing cycle is stopped.

15. The end effector of claim 14, wherein the blow-off mechanism is activated while the mixed dispensing fluid is not continuously exiting an outlet of the dispensing nozzle.

16. The end effector of claim 14, wherein a movement of the end effector is automated.

* * * * *